US005232173A

United States Patent [19]

Planeta

[11] Patent Number: 5,232,173

[45] Date of Patent: Aug. 3, 1993

[54] STRIP WINDING MACHINE

[76] Inventor: Mirek Planeta, 170 Traders Blvd., Mississauga, Ontario, Canada, L4Z 1W7

[21] Appl. No.: 977,479

[22] Filed: Nov. 17, 1992

Related U.S. Application Data

[63] Continuation-in-part of Ser. No. 699,109, May 13, 1991, Pat. No. 5,186,408.

[30] Foreign Application Priority Data

May 14, 1990 [CA] Canada ..... 2,016,764

[51] Int. Cl.[5] ..... B65H 18/16; B65H 19/30

[52] U.S. Cl. ..... 242/65; 242/67.1 R

[58] Field of Search ..... 242/65, 66, 67.1 R, 242/79, 81

[56] References Cited

U.S. PATENT DOCUMENTS

| | | | |
|---|---|---|---|
| 2,703,683 | 3/1955 | Evans et al. | 242/65 |
| 3,103,321 | 9/1963 | Jilek | 242/65 |
| 3,258,217 | 6/1966 | MacArthur et al. | 242/65 |
| 4,390,138 | 6/1983 | Rohde et al. | 242/65 X |
| 5,042,272 | 8/1991 | Furr | 242/65 |

*Primary Examiner*—Stanley N. Gilreath
*Attorney, Agent, or Firm*—Rogers & Scott

[57] ABSTRACT

A winding machine for winding an elongated strip on a core mounted on an axle to form a roll thereon has a support frame and an axle to receive a core on which elongated strip is to be rolled. The support frame has two tranversely spaced parallel side members having tracks supporting opposite end portions of the axle and along which the axle is movable from a winding position to an unloading position, and a driven roller at the winding position to engage elongated strip wound on a core on the axle to rotate the core and wind further strip thereon. The axle with strip wound on the core is moved along the tracks from the winding position to the unloading position. At the unloading position, one end of the axle is held by one side member in a generally horizontal attitude. The other side member has a movable portion which in a supporting position engages and supports an opposite axle end when the axle and roll are at the unloading position and which is movable relative to the remainder of the side member to a removal position to permit the core and roll to be moved endwise off the axle.

4 Claims, 5 Drawing Sheets

STRIP WINDING MACHINE

Figure 1:
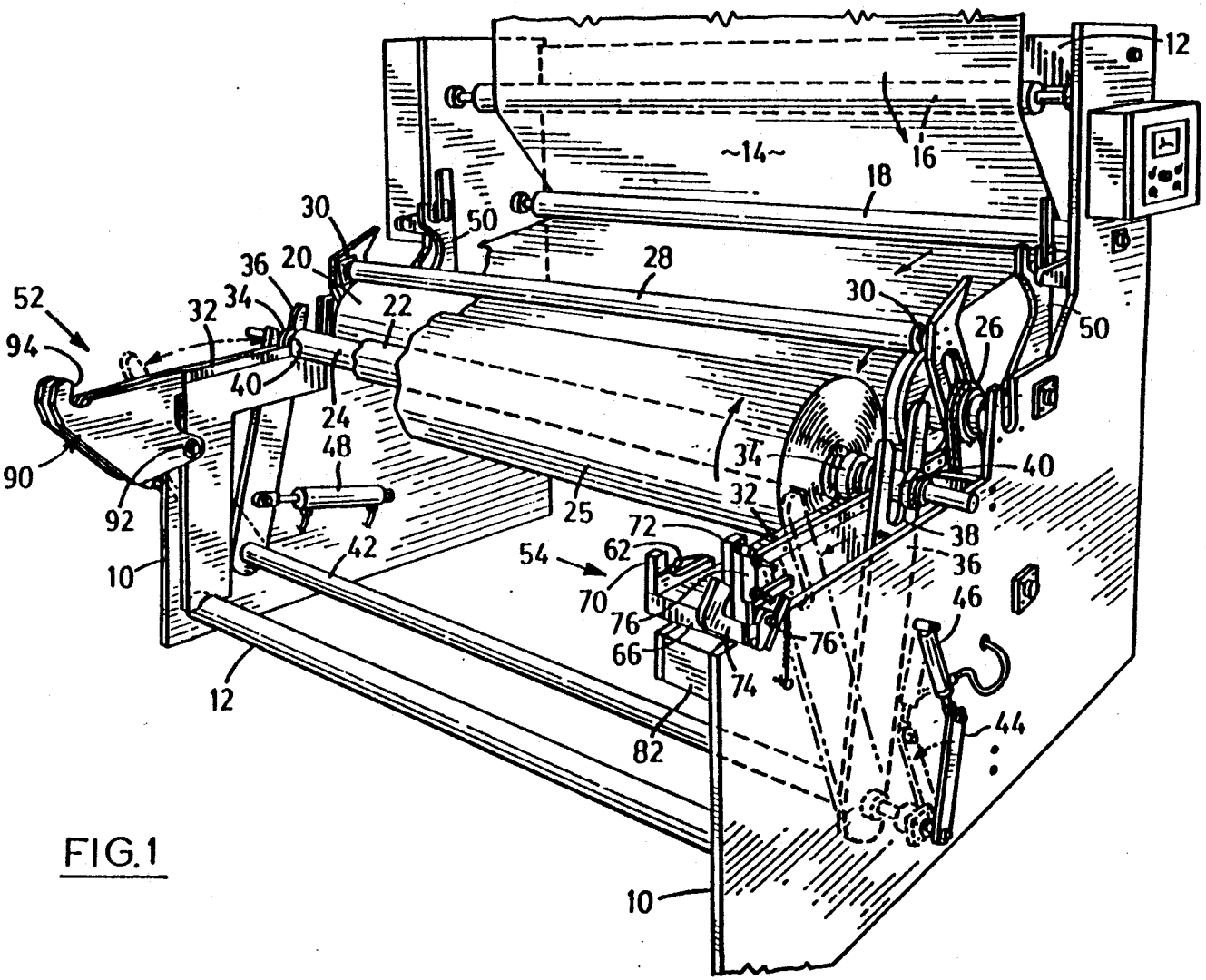

This application is a continuation-in-part of U.S. application Ser. No. 07/699,109 filed May 13, 1991, now U.S. Pat. No. 5,186,408.

This invention relates to machines for winding an elongated strip onto a succession of axle-mounted cores to form a corresponding succession of core-mounted rolls thereof.

There are a number of industries which utilize machines which wind a continuously formed elongated thin strip onto a succession of cores to form a corresponding succession of rolls for storage and transportation. Such thin strips may for example be paper, thin sheet aluminum or synthetic plastic material. Such machines usually have an axle on which an empty core is mounted, the axle being mounted on the machine with the periphery of the core being engaged by a driven roll and between which the strip moves so that rotation of the driven roll causes the strip to be wound onto the core. When the roll is sufficiently full, it is rolled away from the driven roll and a new core and axle combination is positioned to receive the strip. During this change-over stage, the strip is of course cut to detach the full roll and enable the following strip to be wound on the new core.

The removal of a full roll from the machine presents an unexpectedly difficult handling problem. The axle may have a length from about 20 to about 300 inches (50 to 750 cm), more usually in the range of from about 40 to 120 inches (100 to 300 cm). An axle with a length of about 60 inches (150 cm) may itself weigh about 110 lbs (50 kg) and a roll of a synthetic plastic material such as polyethylene on such an axle may have a total weight in the range of from about 250 to 1500 lbs (114 to 680 kg). Longer axles may have a weight of about 330 lbs (150 kg), and rolls of strip on such axles may have a total weight of about 3000 lbs (1365 kg). Such a heavy and awkward load has to be lifted off the machine by a crane without damaging the roll or its surroundings. After removal, the axle has to be extracted from the core and inserted into a new core, with the new core-/axle combination then being used to form a subsequent roll.

It is therefore an object of the invention to provide a winding machine for winding an elongated strip onto a core mounted on an axle which does not require removal of the axle from the machine when a full roll is removed.

According to the present invention, a winding machine for winding an elongated strip on a core mounted on an axle to form a roll thereon comprises a support frame, an axle to receive a core on which elongated strip is to be rolled, the support frame including two tranversely spaced parallel side members having tracks supporting opposite end portions of the axle and along which the axle is movable from a winding position to an unloading position, a driven roller at the winding position to engage elongated strip wound on a core on said axle to rotate said core and wind further strip thereon, means for driving said driven roller, means for moving said axle with strip wound on said core along said tracks from the winding position to the unloading position, axle engaging means at the unloading position mounted on one of the side members and engagable with one end of the axle to hold the axle in a generally horizontal attitude when support is removed from the other end of the axle, the other side member having a movable portion which in a supporting position engages and supports an opposite axle end when the axle and roll are at the unloading position and which is movable relative to the remainder of the side member to a removal position to permit the core and roll to be moved endwise off the axle, and means connected between said other side frame member and the movable portion thereof to move said movable portion between the supporting position and the removal position.

The axle end engaging means may comprise two axially spaced inboard and outboard members mounted on said one side member and against which the axle rests when said axle is in the unloading position, and a retainer member adjacent the outboard stop member movable to a retaining position in which said retainer member extends over the top of the axle and thereby holds the axle in the generally horizontal attitude.

The movable portion of the other side member may be mounted for pivotal movement about a horizontal axis extending transversely of the machine for movement between an upper axle supporting position and a lower roll removal position. The movable portion may have a stop to prevent further movement of the axle when the axle reaches the unloading position from the winding position.

Figure 2:
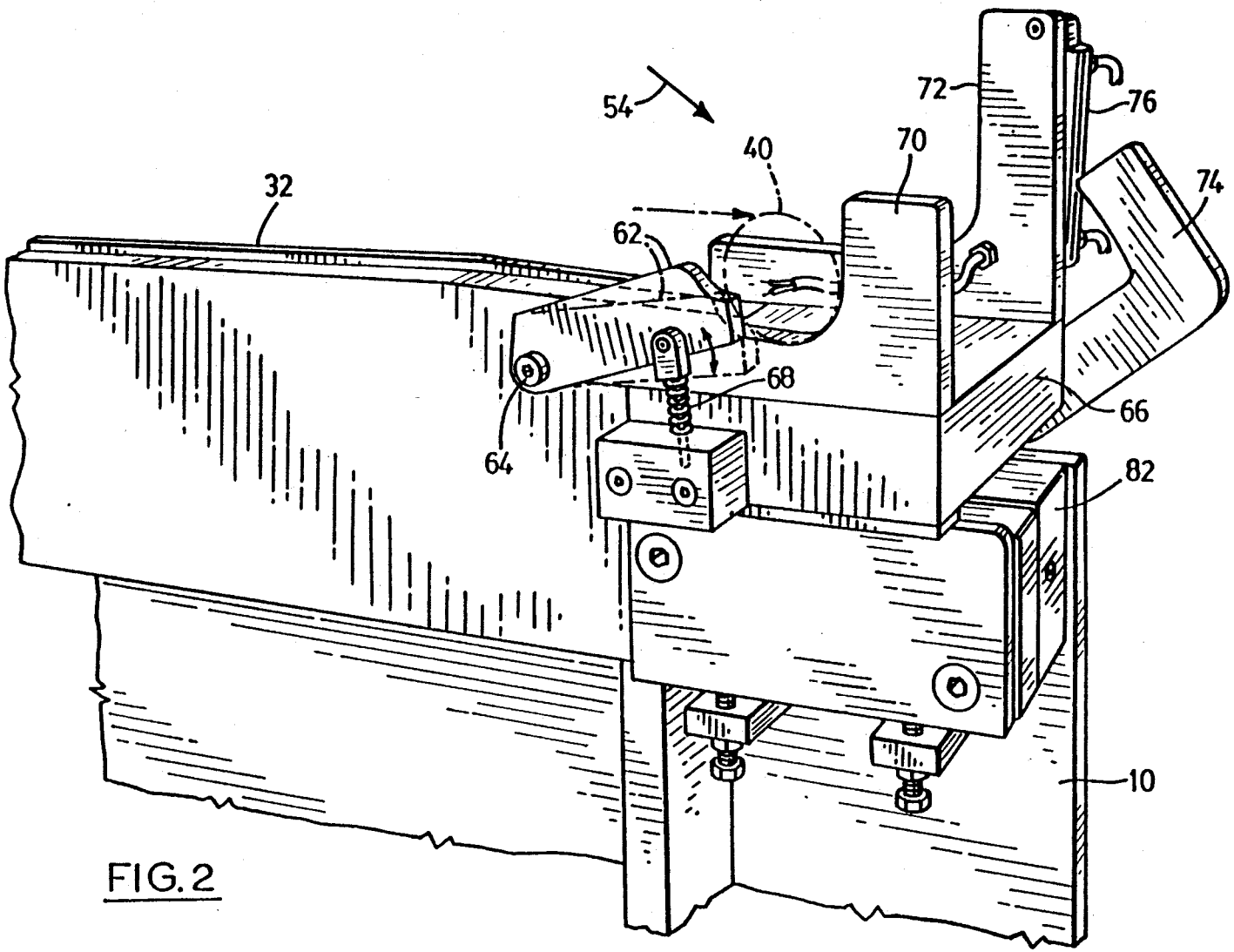
Figure 3:
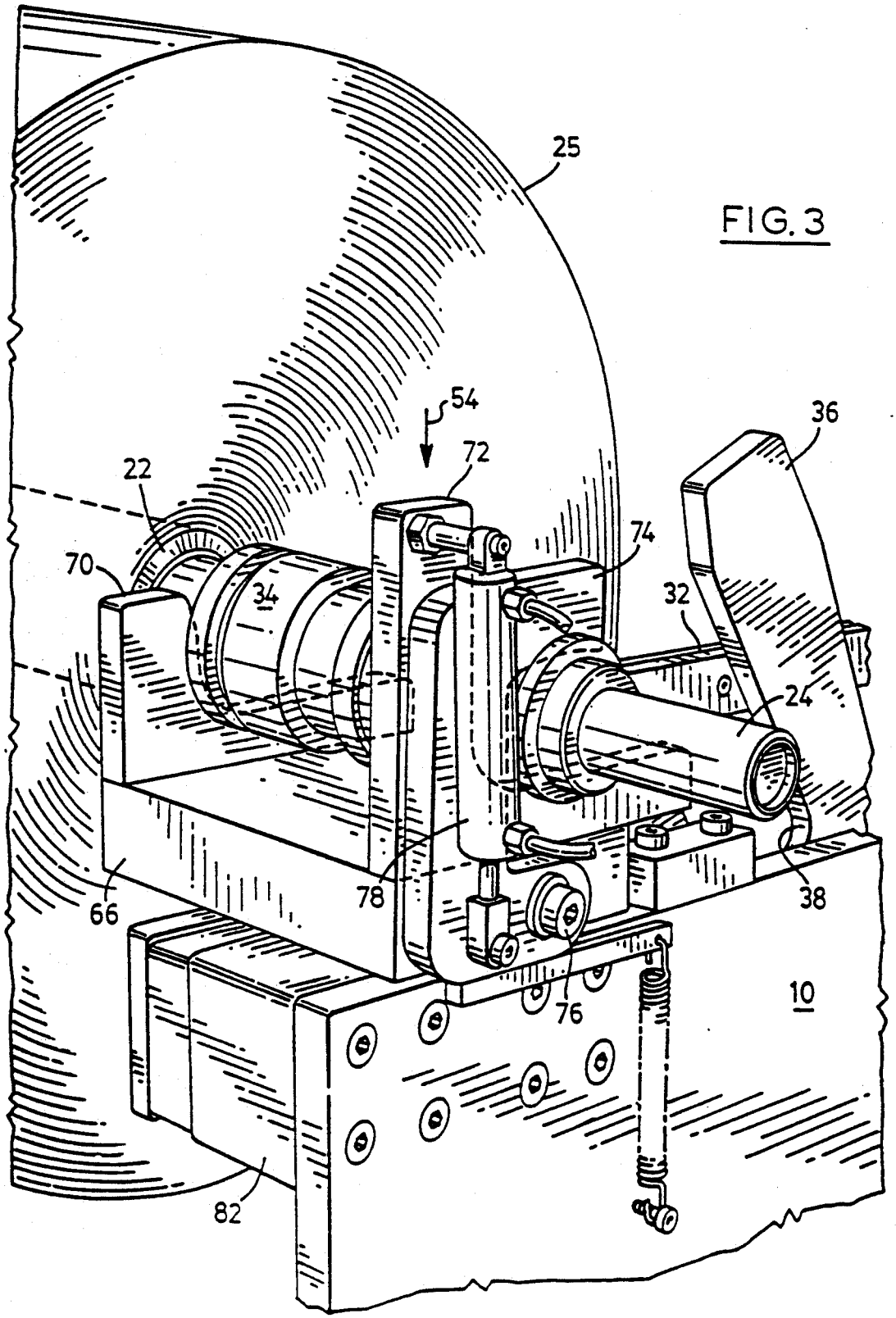
Figure 4:
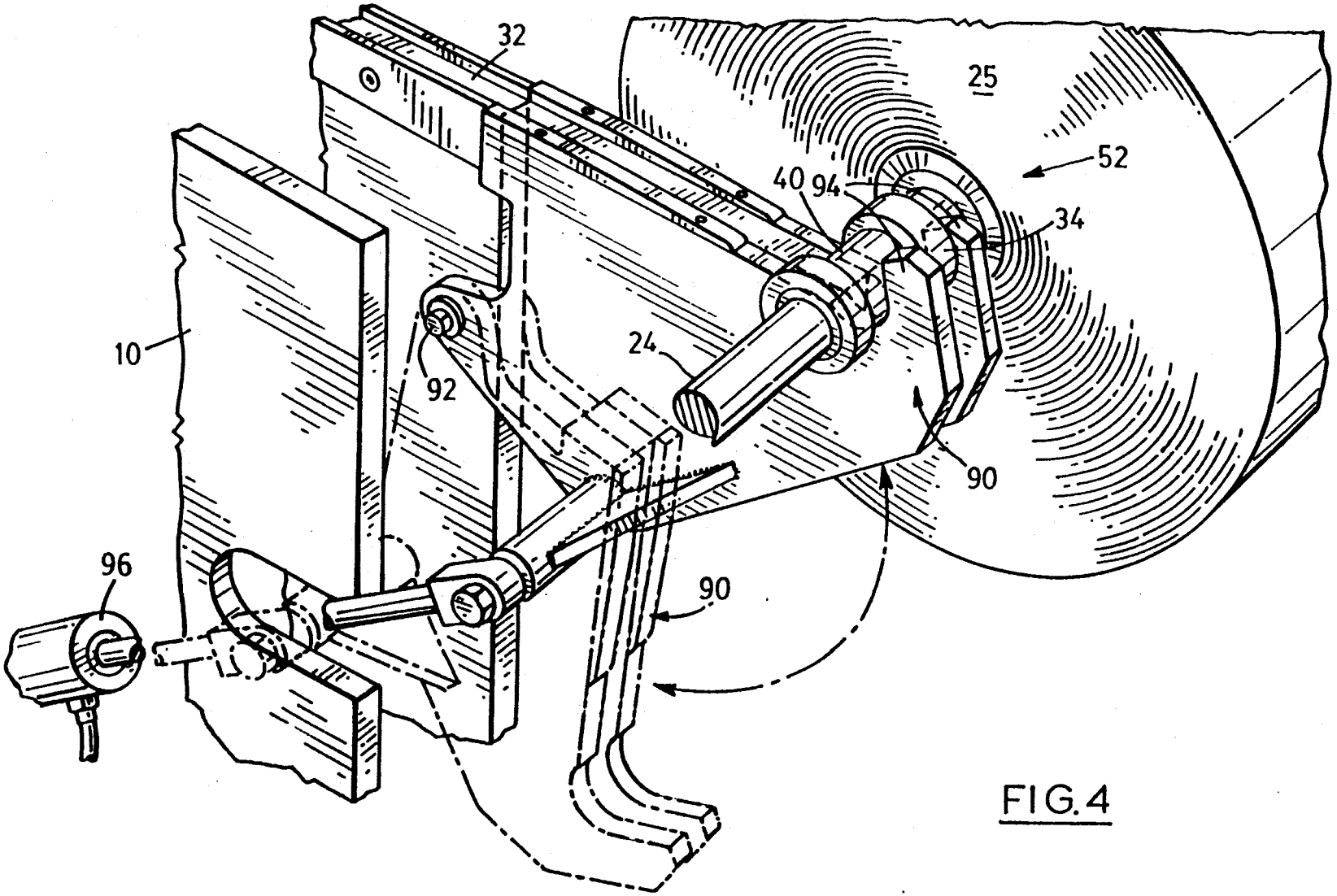
Figure 5:
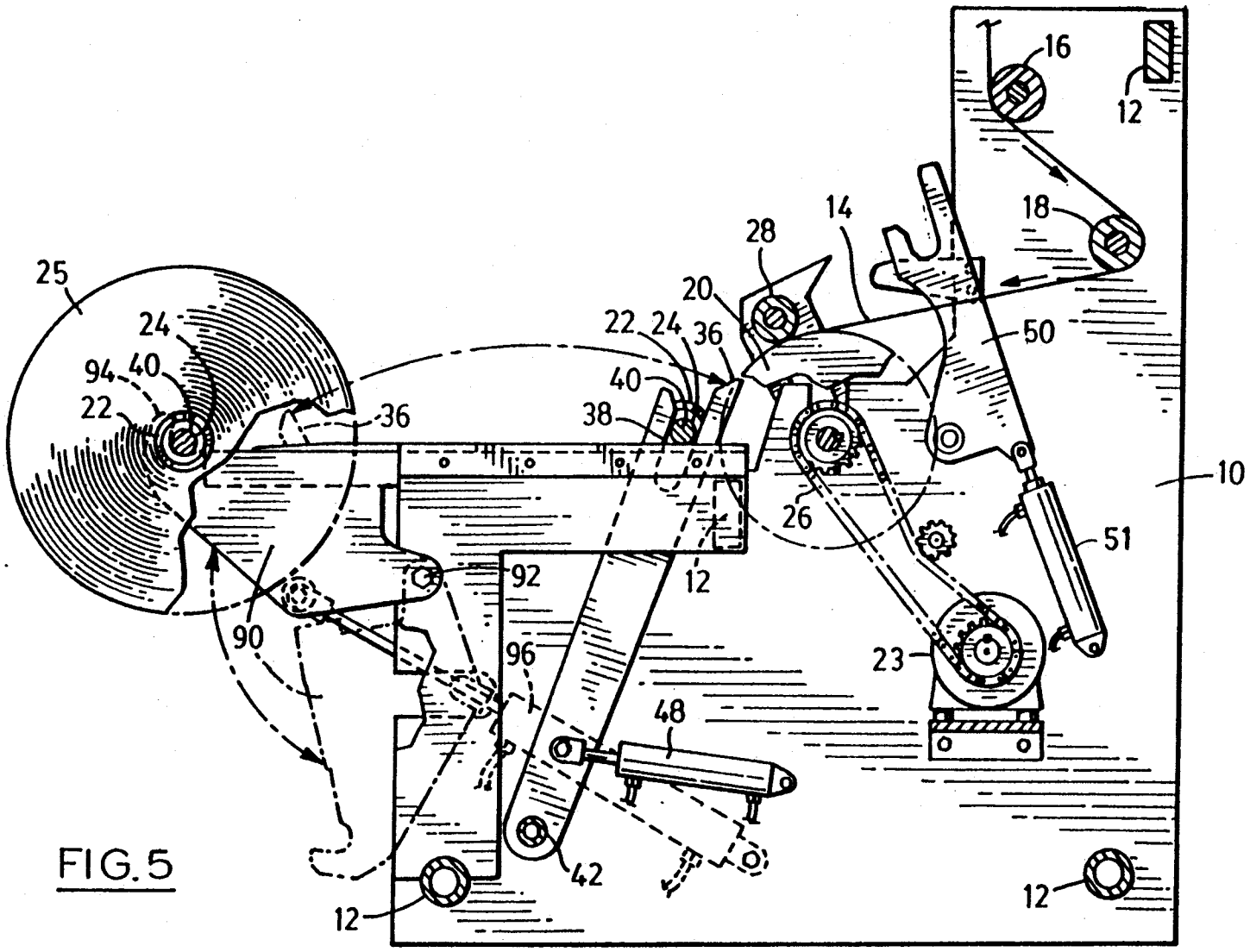

One embodiment of the invention will now be described, by way of example, with reference to the accompanying drawings, of which:

FIG. 1 is a perspective view of a winding machine in accordance with a preferred embodiment of the invention and showing a partially filled roll being wound with strip, FIG. 2 is an enlarged perspective view from the left of empty axle end engaging means on one side member at the unloading position, FIG. 3 is a similar view but from the right and showing a full roll at the unloading position with the respective end of the axle engaged by the axle end engaging means, FIG. 4 is similar view from the left of the movable portion of the other side member in the supporting position with the respective end of the axle of a full roll supported thereby, the roll and core removal position being shown in dotted line, and FIG. 5 is a side view of the machine, with certain portions omitted for clarity, showing the movable portion of the other side member in the roll and core supporting position, the roll removal position being shown in dotted outline.

Referring to the drawings, a winding machine for winding elongated strip on an axle mounted core has two thick parallel side members 10 in the form of metal plates which are rigidly connected by transverse tie members, such as the top and bottom tie members 12 shown in FIG. 1 and FIG. 5, other tie members being omitted for clarity. A strip 14 of material to be wound into rolls, such as a flattened tube of synthetic plastic material produced by die extrusion and subsequent expansion, is guided by rollers 16, 18 to pass over a driven roller 20 onto a roll core 22, the roll core 22 being slidably mounted on an axle 24. The strip 14 is wound onto the core 22 to form a roll 25.

The roll 20 is driven by a motor 23 (FIG. 5) through a chain drive 26, and the strip 14 is held in engagement with the circumference of roll 20 by a pressure roller 28 mounted in bearings 30. The axle 24 is mounted in the winding machine so as to rest adjacent each end on a respective one of a pair of transversely-spaced longitudinally-extending upwardly-open channel tracks 32, each of the tracks 32 being mounted on a horizontal edge of a respective side plate 10. The axle 24 is provided with a larger diameter flange-like portion 34 which engages in the respective channel track 32 to prevent endwise movement of the axle 24. The axle 24 can however move freely along channel tracks 32 as the roll increases in diameter.

The roll 25 is held against the driven roll by two upwardly extending arms 36 provided at their upper ends with open-ended slots 38 which receive respective journal portions 40 of the axle adjacent its ends. Each arm 36 is pivoted at its lower end to the respective side member 10 by an axle 42 which extends across the machine between the two side members 10. On one side, an end of the axle 42 projects from the respective side member 10 and carries an arm 44 connected to a pneumatic spring 46 carried by the side member 10. The spring 46 provides a constant force urging the periphery of roll 25 against driven roll 20 so that the roll 25 is thereby rotated to wind on the strip 14.

When the roll 25 is full, the pressure in spring 46 is released and a pneumatic motor 48 connected between one side member 10 and the respective arm 36 is operated to swing the arms 36 in an anti-clockwise manner in FIG. 1 so as to move the roll 25 along the tracks 32 from the winding position to an unloading position. The tracks 36 terminate short of the unloading position and, at the end of movement of the roll 25 to the unloading position, the axle 24 emerges from the slots 38 in the arms 36. The arms 36 can then be returned to the loading position to receive a new core and axle combination that has previously been placed in a pair of forked pivoted arms 50. The arms 50 are pivoted by a motor 51 (FIG. 5) to lower the new core and axle combination onto the tracks 32 at the winding position to begin winding a new roll. A person skilled in the art will readily appreciate that the strip 14 is cut in an appropriate manner so as to detach the strip 14 from the full roll and present the following strip 14 for winding onto the new core 22.

At the unloading position, the machine has an axle end receiving station 52 on one side and an axle end receiving station 54 on the other side.

At the station 54 (see FIGS. 1, 2 & 3), the respective axle end passes over and depresses a latch 62 which is pivoted at 64 to an axle end support member 66 and urged upwardly by a spring 68. The axle end engages two axially spaced upwardly-extending fixed inboard and outboard end stops 70, 72 respectively on the support member 66, and the latch 62 rises behind the axle end so as to hold it securely against the two stops 70, 72. A strong U-shaped axle retainer member 74 is pivoted at 76 at the end of one of its arms to the support member 66 and is movable outboard of and alongside the outboard stop 72 by a motor 78 between a released position shown in FIGS. 1 and 2 and an engaged position shown in FIG. 3. In the engaged position, the other arm of the U-shaped retainer member 74 extends over the top of the axle 24 outboard of the stop 72 and prevents the outboard axle end from being moved upwardly by the cantilevered weight of the remainder of the axle and the full roll 25. The support member 66 is fastened to a mounting block 82 which in turn is fastened to the side member 10.

The station 52 (see FIGS. 1, 4 and 5) comprises a movable portion 90 of the side member 10, the movable portion 90 being pivotally connected to the main portion of the side member 10 at 92 for movement about a horizontal axis extending transversely of the machine. The movable portion 90 has an end stop 94 which the axle 24 engages at the same time as it engages the stops 70, 72 at the station 54. The removable portion 90 is movable between the upper axle supporting position shown in full lines and a lower axle removal position shown in dotted outline in FIGS. 4 and 5 by a motor 96 pivotally connected between the movable portion 90 and the main portion of the side member 10.

When the full roll 25 is at the removal position, the axle 24 therefore abuts stop 94 on one side of the machine and stops 70, 72 on the other side, with the end of axle 24 adjacent stops 70, 72 being held by retainer member 74. To remove the roll 25, the movable portion 90 of side member 10 is lowered by motor 96 to the position shown in dotted outline in FIGS. 4 and 5. The roll 25 is then supported by support member 66 and retainer member 74 at station 54. In its lower position, movable portion 90 of side member 10 is below the full roll 25 so that the roll 25 and core 22 can be slid off the axle 24 by use of appropriate handling equipment, the nature of which will be readily apparent to a person skilled in the art.

When the full roll 25 and core 22 have been removed from the axle 24, a new core 22 can be slid onto the axle 24 and the movable portion 90 of the side member 10 returned to the upper supporting position. The axle 24 and new core 22 at the removal position can then be moved to the waiting position in forked arms 50, again by use of appropriate equipment the nature of which will be readily apparent to a person skilled in the art.

Other embodiments of the invention will also be readily apparent to a person skilled in the art, the scope of the invention being defined in the appended claims.

I claim:

1. A winding machine for winding an elongated strip on a core mounted on an axle to form a roll thereon, the machine comprising:

a support frame, an axle to receive a core on which elongated strip is to be rolled, the support frame including two tranversely spaced parallel side members having tracks supporting opposite end portions of the axle and along which the axle is movable from a winding position to an unloading position, a driven roller at the winding position to engage elongated strip wound on a core on said axle to rotate said core and wind further strip thereon, means for driving said driven roller, means for moving said axle with strip wound on said core along said tracks from the winding position to the unloading position, axle engaging means at the unloading position mounted on one of the side members and engagable with one end of the axle to hold the axle in a generally horizontal attitude when support is removed from the other end of the axle, the other side member having a movable portion which in a supporting position engages and supports an opposite axle end when the axle and roll are at the unloading position and which is movable relative to the remainder of the side member to a removal position to permit the core and roll to be moved endwise off the axle, and means connected between said other side frame member and the movable portion thereof to move said movable portion between the supporting position and the removal position.

2. A winding machine according to claim 1 wherein the axle and engaging means comprises two axially spaced inboard and outboard stop members mounted on said one side member and against which the axle rests when said axle is in the unloading position, and a retainer member adjacent the outboard stop member movable to a retaining position in which said retainer member extends over the top of the axle and thereby holds the axle in the generally horizontal attitude.

3. A winding machine according to claim 1 wherein the movable portion of the other side member is mounted for pivotal movement about a horizontal axis extending transversely of the machine for movement between an upper axle supporting position and a lower roll removal position.

4. A winding machine according to claim 3 wherein the movable portion has a stop to prevent further movement of the axle when the axle reaches the unloading position from the winding position.

* * * * *